United States Patent [19]

Wolfe

[11] Patent Number: 4,726,513

[45] Date of Patent: Feb. 23, 1988

[54] WINDPROOF ASHTRAY

[76] Inventor: Henry S. Wolfe, 2785 Kipps Colony Dr., Unit 101, Gulfport, Fla. 33707-3947

[21] Appl. No.: 14,830

[22] Filed: Feb. 13, 1987

[51] Int. Cl.[4] ..... A24F 19/00

[52] U.S. Cl. ..... 232/43.1; 131/242

[58] Field of Search ..... 232/43.1, 43.2; 131/242, 231, 237.5; D27/8, 27

[56] References Cited

U.S. PATENT DOCUMENTS

| | | | |
|---|---|---|---|
| 2,340,618 | 2/1944 | Schiszler | 131/242 X |
| 2,495,185 | 1/1950 | Schmitt | 131/242 X |
| 2,595,103 | 4/1952 | Schmaling | 131/242 |
| 2,804,080 | 8/1957 | Keiser | 131/237 |
| 4,390,030 | 6/1983 | Tibbetts | 131/231 |

FOREIGN PATENT DOCUMENTS

| | | | |
|---|---|---|---|
| 1193940 | 9/1985 | Canada | 131/231 |

*Primary Examiner*—Robert W. Gibson, Jr.

*Attorney, Agent, or Firm*—Ronald E. Smith

[57] ABSTRACT

A windproof ashtray. A hollow, aerodynamically configured ashtray structure is provided with a plurality of generally upstanding, circumferentially spaced cigarette-receiving bores, some of which protect a burning cigarette inserted therein from extinguishment while holding it securely against the wind and others of which hold the cigarette securely but which extinguish it. The bores which hold but extinguish cigarettes inserted therein terminate at the oxygen-blocking inside bottom wall of the tray whereas the bores which do not extinguish cigarettes inserted therein terminate in a metal insert member that spaces the burning tip of the cigarette away from any oxygen-blocking surface.

20 Claims, 7 Drawing Figures

WINDPROOF ASHTRAY

BACKGROUND OF THE INVENTION

1. Field of the Invention

This invention relates, generally, to ashtray constructions of the type intended for use out of doors, and more specifically relates to outdoor-use ashtrays having means for either extinguishing or sustaining the burning of the cigarette while it is held by the tray against wind-blown movement.

2. Description of the Prior Art

Ashtrays are commonly employed to collect ashes from cigars and cigarettes. The most common forms of ashtrays are mere trays which serve as receptacles for ashes deposited therein; they include no means for holding a cigarette if the wind is blowing and are thus not suitable for outdoor use.

Outdoor smoking is to be encouraged vis a vis indoor smoking since secondary smoke indoors is likely to be concentrated and harmful to non-smokers present in the same enclosed area as the smoker whereas the great outdoors dissipates at least to some extent the dangerous compounds found in primary and secondary cigarette smoke.

Ashtrays that are currently available, however, are not suitable for outdoor use because cigarettes and their ashes are very light in weight and are easily lifted and scattered by the wind.

A need therefore exists for a cigarette ash tray that would encourage outdoor smoking.

SUMMARY OF THE INVENTION

The present invention encourages outdoor as distinguished from indoor smoking because it enables the smoker to deposit a cigarette into an ashtray even in winds up to forty (40) miles per hour.

It also enables smokers to extinguish their cigarette if desired.

Moreover, it accomodates a plurality of cigarettes at one time and provides a plurality of holding means, some of which hold the cigarette and maintain its burning state and others of which hold the cigarette but which extinguish its fire.

The novel tray is aerodynamically designed so that it can remain in one place even in high winds. It has a circular planform and an elliptical elevational form.

In a preferred commercial embodiment, the novel tray is provided in two equal-sized parts, an upper half and a lower half. The lower half is primarily a base means; the bores which accomodate cigarettes positioned therein are formed in the top half of the structure.

The bores are generally upstanding but tilted from the vertical, away from the center of the tray, to make it easier for a smoker to place a cigarette therein. A cigarette to be held against the wind is placed in a bore, burning tip first; a bore marked "wind proof" indicates a bore that will hold the cigarette and keep it burning, whereas a bore marked "out" will hold the cigarette but extinguish it.

The bottom portion of the tray is imperforate whereas the upper portion, in addition to having the bore means formed therein, also has a central aperture formed therein to admit sufficient oxygen into the confines of the tray to ensure continued burning of those cigarettes positioned in the "wind proof" bores.

A dome-like structure is formed in the center of the lower half of the hollow ashtray to inhibit ashes within the tray from exiting the central aperture formed in the upper half of the tray. The dome-like structure is preferably integral with the bottom portion of the tray structure and the apex of the dome is spaced below the plane of the central aperture formed in the top half but the entire dome-like protrusion is concentric with said tray top member central aperture.

The "out" bores terminate at the bottom of the tray and a cigarette placed, burning end first, into an "out" bore will be extinguished when the tip is inserted thereinto. It is not necessary to crush the tip of the cigarette into said bottom wall, however, as the fire will go out even if the burning tip never contacts the bottom wall.

The "out" bores are positioned near the periphery of the tray so that the length of the "out" bores is only about one and one-half inches (1½").

The "windproof" bores, however, are provided with a metal insert that has a first end secured to the upper periphery of its associated bore, a medial cylindrical portion which serves as a bore lining, and a base portion which is spaced upwardly of the bottom of the tray and which supports the burning tip of a cigarette without extinguishing it.

More specifically, the base plate of each "wind proof" insert has the form of a sector representing about one-sixth or one-seventh of a circle. A sector being a geometrical figure bounded by two radii and the included arc of a circle, said base plate is therefore understood to be wedge-shaped. This small support surface allows oxygen to reach the five-sixths or six-sevenths of the burning tip not in contact with said base plate, thereby assuring that the fire will not be extinguished.

The base plate member is spaced sufficiently downward of the bore's opening, however, to ensure that about one inch (1") of the cigarette will be inside the tray so that the cigarette cannot be blown away by the wind.

It is therefore clear that the primary object of this invention is to encourage outdoor smoking as distinguished from indoor smoking by providing an ashtray having utility in windy environments.

A more specific object is to provide an ashtray that has means for holding a cigarette against wind displacement while allowing the cigarette to remain lit.

Another specific object is to provide an ashtray of the foregoing type but which, if in accord with the intentions of the tray's user, can extinguish the cigarette in addition to holding it.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
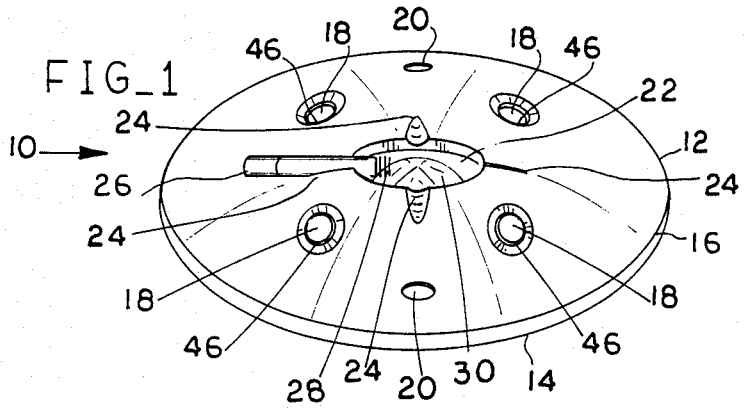
FIG. 1 is a perspective view of the novel ashtray in its assembled configuration.

Referring now to FIG. 1, the reference numeral 10 indicates the inventive tray as a whole.

It has a top half 12 and a bottom half 14 that are press fit together at a parting line 16. The tray 10 can thus be disassembled easily for cleaning by simply manually separating the two half portions 12, 14 from one another.

The bores marked "wind proof" are collectively designated 18 and the bores marked "out" are collectively designated 20.

The number and spacing of the bores 18 and 20 is entirely arbitrary, but in the illustrative embodiment of the invention depicted in the drawings, the "wind proof" bores 18 are equidistantly and circumferentially spaced and are four (4) in number whereas the "out" bores 20 are diametrically opposed to one another and are two (2) in number.

It will be observed that the "out" bores 20 are further from the center of tray 10 vis a vis the "wind proof" bores 18; due to the elliptical shape of tray 10 in side elavation, this means that a cigarette placed in an "out" bore 20 has but a short distance to traverse interiorly of tray 10 before its tip abuts the inside bottom wall of lower half 14 of tray 10. However, the tip need not contact the bottom wall for the fire to be extinguished and each "out" bore 20 is specifically dimensioned to hold the burning tip of the cigarette in spaced relation to said bottom wall.

An opening 22 is formed centrally of top half member 12 and radial grooves 24 communicate therewith so that a cigarette 26 may be cradled in a groove 24 with its burning tip 28 suspended over an edge of opening 22; this allows tray 10 to be used as a conventional tray indoors or outdoors when the wind is not blowing.

A dome-like protrusion 30 formed integral with bottom half member 14 is also visible in FIG. 1. Dome 30 provides a surface against which cigarettes may be extinguished independently of "out" bores 20 and by its proximity to opening 22 it further reduces the chances that the wind will disturb ashes within the hollow interior of tray 10.

Figure 2:
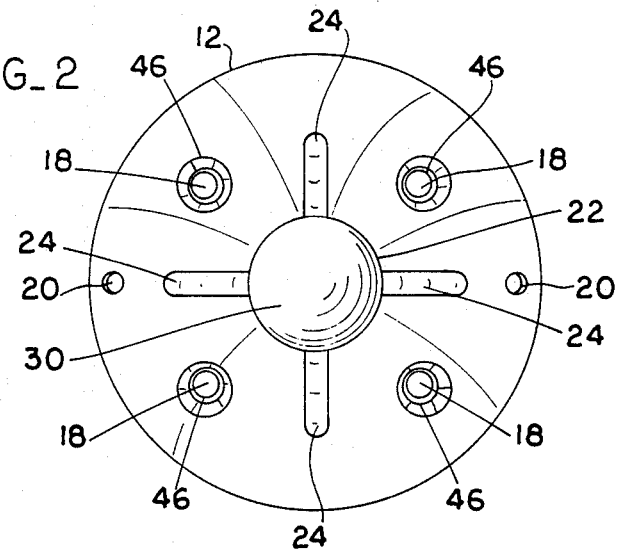
FIG. 2 is a top plan view of the novel tray.
Figure 4:
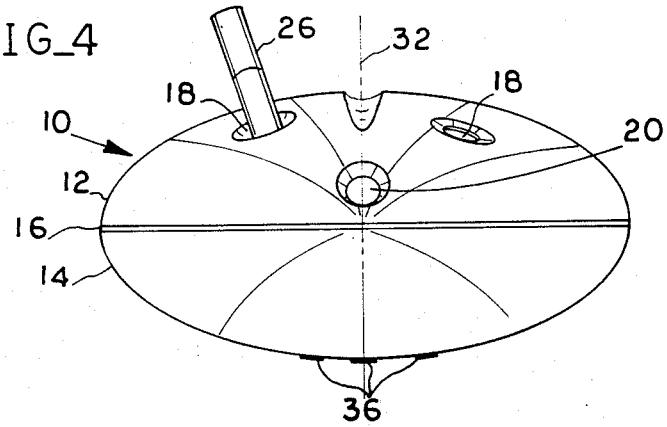
FIG. 4 is a side elevational view of the assembled tray.

FIG. 2 shows that dome 30 and opening 22 are concentrically disposed with respect to one another and thus share a common, imaginary vertical axis of symmetry denoted 32 (FIG. 4).

Figure 3:
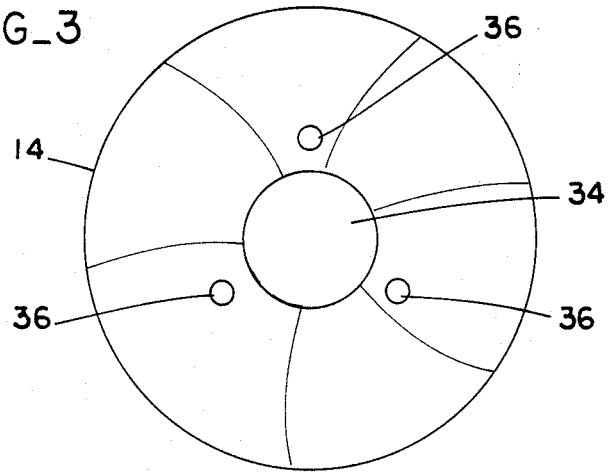
FIG. 3 is a bottom plan view thereof.

Dome 30 is hollow and thus a dome-shaped recess 34 is formed in bottom half member 14 as depicted in FIG. 3.

Circumferentially and equidistantly spaced leg members 36 serve to support tray 10 on a level support surface, not shown.

Leg members 36 are very short as shown in FIG. 4. The aerodynamic profile of the novel tray is shown in FIG. 4 as well; this elliptical profile is presented to wind blowing in a substantially horizontal direction and thus the tray 10 is very stable even in high winds.

FIG. 4 also shows that a cigarette 26 in any bore 18 or 20 will be angled at about twenty degrees from a vertical axis.

Figure 5:
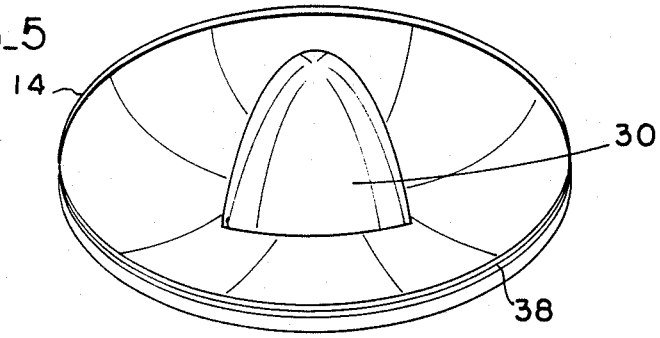
FIG. 5 is a perspective view of the lower half of the tray.

FIG. 5 not only shows dome 30 more fully, but it also shows an annular shoulder 38 formed in the upper peripheral rim of tray bottom half member 14.

Figure 6:
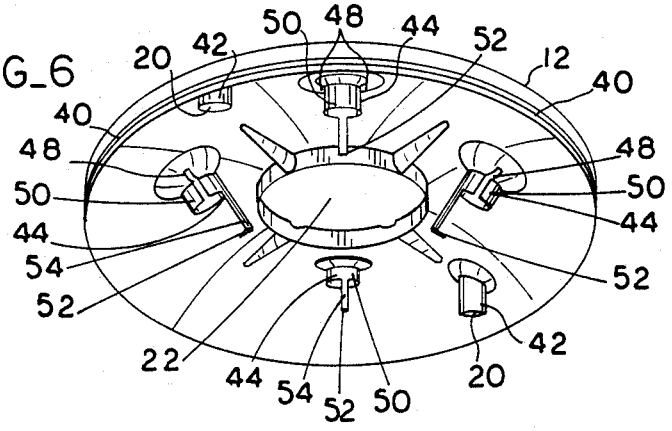
FIG. 6 is a perspective view of the upper half of the tray in an inverted position to better depict structural details.

FIG. 6 shows the peripheral rim 40 of the upper half member 12 that is snugly received against annular shoulder 38 when tray 10 is assembled.

More importantly, however, FIG. 6 indicates how bores 18 and 20 are defined.

It is clear that the "out" bores 20 are defined by cylindrical members 42 and that the "wind proof" bores 18 are defined by insert members 44.

More specifically, cylinder members 42 are integral with top half member 12 and depend to the circular bore-entrance openings formed in said top half member 12.

Insert member 44, however, are separately formed for ease of manufacturing purposes since tray 10 and cylinder members 42 are preferably of fire-retarding high impact plastic construction, specifically, of Melamine (Trademark), whereas the insert members 44 are of metallic construction since they are designed to be in abutting contact with burning cigarette tips for extended periods of time.

The respective uppermost rims 46 of insert members 44 are shown in FIGS. 1 and 2, it being understood that said rims 46 abuttingly engage the circular bore-entrance openings of the "wind proof" bores 18. Said rims 46 are outwardly turned flange members as those skilled in the mechanical arts will readily appreciate; the flanges prevent insert member 44 from simply falling through its associated opening 18 and provide an annular engaging surface between each rim 46 and hence each insert member 44 and its associated opening 18.

Figure 7:
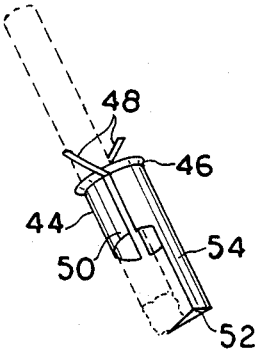
FIG. 7 is a perspective view of a metallic insert of the type employed in the bores of the novel tray that are denoted "wind proof."

Mounting members 48 are formed from cylinder portion 50 of each insert member 44 and bent radially outwardly therefrom as depicted in FIGS. 6 and 7; the mounting members or radial arms 48 thus cooperate with rim or flange members 46 to compressively engage top member 12 which is positioned in sandwiched relation between a rim 46 and its associated radial arms 48. In this manner, insert members 44 are tightly secured to their respective operative positions.

Those skilled in the art of machine design could securely mount insert members 44 by other techniques, it being understood that the construction shown has been found to be economical but the invention is not limited to such preferred construction.

As one of many possible examples, an adhesive could obviate the need for the particular mounting means shown.

The integral formation of rim 46 and cylinder portion 50 of each insert member 44 is perhaps best understood in connection with FIG. 7.

It will also there be seen that a wedge-shaped base member or cigarette support plate 52 is bent at a ninety (90) degree angle relative to a leg portion 54 that depends to cylindrical portion 50. In the commercial embodiment of this invention, the distance between support plate 52 and the entrance to bore 18 is about one inch (1"); accordingly, a cigarette inserted into a bore 18, burning tip first, will rest atop support wedge 52 and will have about one inch (1") of its length slideably received within bore 18, it being understood that bore 18 is imaginary but defined by the circular entrance thereto formed in top half member 12 and the space defined by insert member 44, of course.

Wedge or sector-shaped support plate 52 represents about one-sixth of a circle since it includes an arc or about sixty (60) degrees. Thus, a cigarette resting thereatop will still have five-sixths (5/6ths) of its burning tip exposed to the oxygen-containing air within tray 10 and will thus not be extinguished.

The exact size of plate 52 is not critical to this invention, although empirical studies could be undertaken by interested parties, in light of the disclosure made herein, to determine the maximum allowable size of the sector-shaped support plate 52 and the results of such studies would be within the teachings of this invention as made clear by the claims appended hereto.

This invention pioneers the art of windproof ashtrays since it contains the breakthrough disclosure of a means for holding a cigarette in a windy environment without extinguishing said cigarette, and includes a number of other novel features as well, as those skilled in the art will appreciate.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A windproof ashtray, comprising:
a hollow housing member;
a cavity the outer boundaries of which are defined by said housing member;
said cavity defining an oxygen-containing, substantially dead air space where air currents are minimal;
a first aperture member formed in a top wall of said hollow housing member;
a cigarette-supporting base member positioned at a preselected location within said cavity, said preselected location being in substantial alignment with said first aperture member;
said base member being small in configuration relative to the diameter of a cigarette so that only a small portion thereof supportingly abuts the burning end of a cigarette supported thereby;
whereby the burning end of a cigarette inserted into said cavity through said first aperture member is supported by said base member and is provided with sufficient oxygen to enable it to continue burning and is protected from extinguishment by wind in the environment external to said housing.

2. The ashtray of claim 1, wherein said base member forms a part of a cigarette-supporting member associated with said first aperture member.

3. The ashtray of claim 2, wherein said cigarette-supporting member includes an aperture rim-engaging means, said base member and an interconnecting member that extends from said rim-engaging means to said base member.

4. The ashtray of claim 3, wherein the length of said interconnecting member is preselected so that said base member is spaced upwardly of a bottom interior wall of said ashtray member so that a cigarette supported by said base member is spaced upwardly of said ashtray bottom wall.

5. The ashtray of claim 4, further comprising:
a second aperture member formed in a top wall of said ashtray housing member;
said aperture member comprising means for extinguishing a cigarette the burning tip of which is inserted thereinto.

6. The ashtray of claim 5, wherein said rim-engaging means is a cylindrical member having an outwardly extending flange member that abuttingly engages an exterior surface of a top wall of said housing member at the periphery of said first aperture member.

7. The ashtray of claim 6, wherein said cylindrical member has a pair of radially extending arm members cut out therefrom, said arm members positioned to abuttingly engage an interior surface of said top wall of said housing member, and said arm members cooperating with said flange means to secure said cigarette-supporting member in its operative position in registration with said first aperture member.

8. The ashtray of claim 7, wherein said base member is integrally formed with said interconnecting member and is bent normal to a longitudinal axis thereof so that said base member is substantially parallel to the plane of said top wall member.

9. The ashtray of claim 8, wherein said base member has the configuration of a sector.

10. A windproof ashtray, comprising:
a hollow housing member having an oxygenated interior cavity;
a first plurality of circumferentially spaced aperture members formed in a top wall of said housing member;
a plurality of insert members, each insert member being adapted to be inserted into a hollow cavity defined by said housing member and being adapted to engage its associated aperture member;
each of said insert members having a rim-engaging means that engages the rim of its associated aperture member, a cigarette-supporting base member, and an interconnecting member that interconnects said rim-engaging means and said base member;
said respective base members having a small dimension relative to the transverse dimension of a cigarette;
each interconnecting member having a linear configuration so that each base member is substantially aligned with its associated aperture member;
each interconnecting member having a preselected length that positions said base member upwardly of an interior bottom wall of said housing member;
whereby the burning end of a cigarette inserted into a first aperture member will be supported by said base member in spaced relation to an interior bottom wall of said housing member so that a smoldering fire burning in said cigarette burning end will continue burning in the oxygenated environment within said housing.

11. The ashtray of claim 10, further comprising:
a second plurality of circumferentially spaced aperture members formed in a top wall of said housing member;

each of said second plurality of aperture members being in open communication to an interior bottom wall of said housing member;

whereby a fire in a burning end of a cigarette inserted into any of said second plurality of aperture members is extinguished.

12. The ashtray of claim 11, wherein said housing member has a circular planform and is elliptical in configuration in side elevation so that it presents an aerodynamic profile to air currents external to said housing member.

13. The ashtray of claim 12, wherein said second plurality of aperture members is spaced radially outwardly of said first plurality of aperture members.

14. A windproof ashtray, comprising:

a hollow housing member having a circular planform and an elliptical elevational form;

a central aperture member formed in a top wall of said housing member;

a dome-shaped member formed in a bottom wall of said housing member, centrally thereof, projecting upwardly therefrom, and having its apex positioned substantially coincident with a plane defined by said top wall member of said housing member so that said apex does not extend through said central aperture member;

said dome-shaped member having its axis of symmetry coincident with the center of said central aperture member;

a first plurality of circumferentially spaced aperture members formed in said top wall of said housing member;

a plurality of insert members positioned in engaging relation to their associated aperture members;

each of said insert members operative to supportingly engage the burning end of a cigarette inserted into its associated aperture member without extinguishing the same;

whereby said central aperture member admits oxygen into the hollow interior of said housing member;

and whereby said dome-shaped member provides a surface against which burning cigarettes can be extinguished and further provides a barrier means so that air currents external to said housing member are substantially barred from causing air currents within said housing member.

15. The ashtray of claim 14, wherein each of said insert members has a rim-engaging element that secures said insert member to its associated aperture member, a base element that supportingly engages the burning tip of a cigarette supported thereby, and a linear in configuration interconnecting element that interconnects said rim-engaging element and said base element and that aligns said base element with said aperture member.

16. The ashtray of claim 15, wherein said base element has a small dimension relative to the transverse dimension of a cigarette so that the burning end of a cigarette supported by said base element will remain exposed to oxygen within said hollow housing member.

17. The ashtray of claim 16, further comprising a second plurality of aperture members formed in a top wall of said housing member.

18. The ashtray of claim 17, wherein said second plurality of aperture members are in open communication to an interior bottom wall of said housing member so that the burning end of a cigarette inserted into one of said second plurality of aperture members is extinguished.

19. The ashtray of claim 18, wherein said second plurality of aperture members is positioned radially outwardly of said first plurality of aperture members.

20. The ashtray of claim 19, further comprising:

a first indicia means associated with each member of said first plurality of aperture members;

each of said first indicia means indicating that its associated aperture member is operative to accept and retain against displacement by wind the burning end of a cigarette without extinguishing the fire smoldering therein;

a second indicia means associated with each member of said second plurality of aperture members;

each of said second indicia means indicating that is associated aperture member is operative to accept, retain against displacement by wind the burning end of a cigarette, and to extinguish the fire smoldering in said burning end.

* * * * *